United States Patent [19]

Matsuzaki et al.

[11] Patent Number: 4,486,353

[45] Date of Patent: Dec. 4, 1984

[54] PROCESS OF EXTRACTING VEGETABLE OIL AND FAT

[75] Inventors: Narihide Matsuzaki, Yokohama; Tasuke Oshima, Kawasaki; Akira Nishioka, Yokohama, all of Japan

[73] Assignee: Ajinomoto Company Incorporated, Tokyo, Japan

[21] Appl. No.: 415,235

[22] Filed: Sep. 7, 1982

[30] Foreign Application Priority Data

Sep. 4, 1981 [JP] Japan ..... 56-139534

[51] Int. Cl.[3] ..... C118 1/12

[52] U.S. Cl. ..... 260/412.4; 260/123.5; 260/427; 260/428.5; 426/430; 568/917

[58] Field of Search ..... 260/412.4, 123.5, 427, 260/428.5; 568/917; 426/430

[56] References Cited

U.S. PATENT DOCUMENTS

| | | | |
|---|---|---|---|
| 2,176,851 | 10/1939 | Brewer et al. | 260/427 |
| 2,584,108 | 2/1952 | Beckel et al. | 260/412.4 |
| 3,970,764 | 7/1976 | Karnofsky | 426/430 |
| 4,144,229 | 3/1979 | Karnofsky | 426/656 X |
| 4,219,470 | 8/1980 | Karnofsky | 260/123.5 |
| 4,359,417 | 11/1982 | Karnofsky et al. | 260/123.5 |
| 4,359,592 | 11/1982 | Chao et al. | 568/917 X |

*Primary Examiner*—Helen M. S. Sneed

*Attorney, Agent, or Firm*—Oblon, Fisher, Spivak, McClelland & Maier

[57] ABSTRACT

A process of extracting vegetable oil and fat from an oleaginous raw material which comprises the steps of obtaining flakes having a moisture content of from 0.7 to 10 weight % from an oleaginous raw material; contacting the flakes with an ethanol solution containing not less than 90 weight % ethanol at a temperature in the range of from 70° C. to the boiling point of the ethanol solution, thereby obtaining a miscella; cooling the miscella, thereby obtaining vegetable oil or fat and a separate defatted miscella; drying the defatted miscella with a molecular sieve material having a pore size of from 3 Å to 4 Å, thereby obtaining a second ethanol solution wherein the second ethanol contains less than 7 weight % water; and using the ethanol solution obtained in the drying step as the ethanol solution of the contacting step in a second extraction.

6 Claims, 1 Drawing Figure

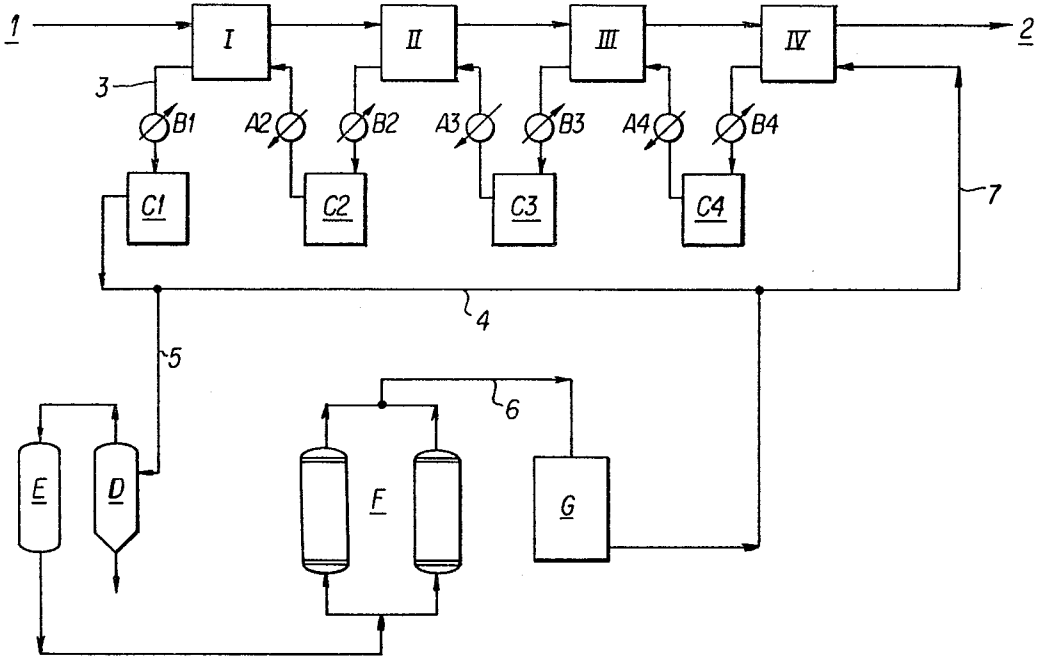
1
2
3
4
5
6
7
I
II
III
IV
B1
B2
B3
B4
A2
A3
A4
C1
C2
C3
C4
D
E
F
G

PROCESS OF EXTRACTING VEGETABLE OIL AND FAT

BACKGROUND OF THE INVENTION

1. Field of the Invention

The present invention relates to a process of extracting vegetable oil and fat, and particularly relates to a process of extracting vegetable oil and fat by contacting a flaked oleaginous material with an ethanol solution of high ethanol concentration.

2. Description of the Prior Art

Methods of extracting vegetable oil and fat by contacting an ethanol solution with an oleaginous material are known; for example, Japanese Kokai No. 51-89506 (U.S. Pat. No. 3,970,764), Japanese Kokai No. 52-38050 (U.S. Pat. No. 4,219,470), and Japanese Kokai No. 53-77249 (U.S. Pat. No. 4,144,229). However, in these known processes, a dehydration step is required to increase oil solubility in ethanol. For the dehydration process, a distillation is typically used. However, there are many problems in distillation. For example, ethanol and water form a minimum boiling mixture theoretically at 96 weight % ethanol, but in practical processes at 94 weight % ethanol. Since the oleaginous raw material contains some water originally, the ethanol concentration of the extracted solution is from 92 to 93 weight % after the extraction process. Within this range oil solubility is from 4.9 to 6.3 weight % even at the boiling point of the ethanol solution. Therefore it is necessary to use precision distillation methods to obtain highly concentrated ethanol solution, for example, reduced pressure distillation, extractive distillation, and azeotropic distillation. But reduced pressure distillation and extractive distillation have problems associated with their operation such as loss of ethanol. Azeotropic distillation requires other chemicals, such as benzene or cyclohexane, which are undesirable for the foods industry. Furthermore, distillation methods require several times as much energy as the latent heat of ethanol. Therefore, they are unsuitable for practical plant operations.

SUMMARY OF THE INVENTION

Accordingly, one object of the present invention is to provide a method for extracting vegetable oil and fat by contacting a flaked oleaginous material with an ethanol solution having a high ethanol concentration. Another object is to remove excess water and other materials which increase undesirable odors and tastes in the defatted products. A further object is to use a mixture having a high ethanol concentration as the circulating solvent and to increase the yield of extracted oil and fat. Yet another object is to improve the quality of oil and fat obtained, that is, to remove coloring matter, to remove vegetable odor and to decrease the content of free fatty acids.

These and other objects of the invention have been accomplished by providing a method of extracting vegetable oil and fat from an oleaginous raw material, which comprises the steps of obtaining flakes having a moisture content of from 0.7 to 10% from said oleaginous raw material; contacting said flakes with an ethanol solution containing not less than 90 weight % ethanol at a temperature in the range from 70° C. to the boiling point of said ethanol solution, thereby obtaining a miscella; cooling said miscella, thereby obtaining vegetable oil or fat and a separate defatted miscella; drying said defatted miscella with a molecular sieve material having a pore size from 3Å to 4Å, thereby obtaining a second ethanol solution, wherein said second ethanol solution contains less than 7 weight % water; and using said second ethanol solution as the ethanol solution of said contacting step in a second extraction.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing, wherein:

The FIGURE is a flow scheme showing the present process as exemplified by Example 1.

DESCRIPTION OF THE PREFERRED EMBODIMENTS

For the first step of the invention (step (a)), flakes having a moisture content of from 0.7 to 10% are obtained from an oleagious raw material. The raw oleagious materials which are employed in the present invention include seeds; for example, soybean, rape, cotton, peanut, sesame, and sunflower seeds; and germs; for example, from corn, wheat, and rice. The raw oleagious materials which are extracted by hexane in other known processes are all suitable. The word "flake" is not intended to be limiting to any particular shape but indicates that any impervious outer hull or coat has been removed and the remainder of the seed or germ has been reduced in size, if necessary, for ease of extraction.

One example of obtaining flakes involves the following steps. Skins are removed from soybeans which are then rolled to form flakes from 0.2 mm to 0.6 mm in thickness. If the moisture of the flake is more than 10%, the extracting yield of oil or fat will be decreased, and the dehydrating process will require a lot of energy. Before or after the rolling process, the moisture of the flake is controlled to from 0.7 to 10 weight %. If the moisture of the flake is reduced to less than 0.7%, both the oil and fat and the defatted products are harmed by either heating or drying processes. The degree of drying is determined in consideration of the alcohol concentration at the extraction step and by the required quality of the oil and fat and defatted products. It is preferable to dry the flakes as much as possible, since water in the flakes reduces the alcohol concentration of the extraction solvent. For example, when using a 93 weight % ethanol solution, the flakes are dryed to 2.1% moisture. When using an ethanol solution of 98 wt % conc., the flakes are dryed to 0.9% moisture, preferably.

For the second step (step (b)), the flakes of step (a) are contacted with an ethanol solution having an ethanol concentration of not less than 90 weight % at a temperature in the range of from 70° C. to the boiling point of said ethanol solution, and a miscella is obtained.

Oil and fat are extracted near the boiling point of ethanol, and separated from the defatted material and the miscella by cooling in a later step. It is necessary that the ethanol concentration of the extracting solution in this step be not less than 90 weight %, preferably not less than 95 weight %. If the ethanol concentration is less than 90 weight %, oil and fat in the flakes are not extracted to the extent desired. Furthermore, it is necessary that the extracting temperature be in the range from 70° C. to the boiling point of said ethanol solution.

If the extracting temperature is lower than 70° C., the solubility of oil and fat is low, and the extracting yield is undesirably low. If the extracting temperature is higher than the boiling point of said ethanol solution, a pressurized extractor is required as otherwise the evaporation of ethanol is violent. The method of extraction is not limited, with the ordinary methods of extraction, for example, batch extraction, semi-continuous counter-current extraction, and continuous counter-current extraction, being suitable.

For the third step (step (c)), the miscella of step (b) is cooled to a temperature of from 35° C. to 10° C., and oil and fat are isolated by a separator from the residue of the miscella. If the cooling temperature is higher than 35° C., the yield of oil and fat decreases as the solubilities of oil and fat in ethanol are high. If the temperature is lower than 10° C., an undesirable amount of energy is required for the cooling process. Apparatus for separating oil and fat include centrifuges, decanters, or sedimentation apparatus, etc. The defatted miscella, which contains substantially no oil and fat, will later be heated to the extraction temperature and used as the extracting solvent for the next batch of flakes.

For the fourth step (step (d)), the defatted miscella of step (c) is contacted with a molecular sieve material having a pore size in the range of from 3Å to 4Å to obtain an ethanol solution containing less than 7 weight % water. Preferably, the defatted miscella of step (c) is distilled under normal pressure or reduced pressure, then contacted with molecular sieves. It is possible by this distillation to remove dissolved matter from the alcohol, and therby prevent a decrease in the dehydration activity of the molecular sieve material. Under certain circumstances only a part of the defatted miscella of step (c) is contacted with molecular sieves to obtain an ethanol solution containing less than 7 weight % water.

The molecular sieve material may be a crystalline zeolite, which is shown by the fundamental formula as $M_{2/n}O.Al_2O_3xSiO_2.yH_2O$ (M=metalic cation, n=atomic valence). There are additionally many synthetic zeolites which have different chemical compositions and structures which may be used. In the present invention a molecular sieve in which the pore size is from 3Å to 4Å is used. The fundamental unit of the zeolite structure is a regular tetrahedron having a silicon or aluminum cation at the center surrounded by four oxygen anions at the corners of the tetrahedron. The four oxygen anions are shared by the neighbor tetrahedrons. The crystaline structure formed by this unit has comparatively large holes and resembles a bee hive. The holes are connected to each other. Examples of molecular sieves having pore size from 3Å to 4Å include "Molecular Sieve 3A", "Molecular Sieve 4A" (made by Union Carbide Co.), "SEOLAM A-3" (made by Toyo Soda Manufacturing Co., Ltd.), "NIKKA PELET KZ" (made by Nippon Kassei Hakudo Co., Ltd.), etc. Any shape of molecular sieve can be used, for example, a powder, pellet or bead, of which the particle size may be from 4 mesh to 10 mesh, etc.

Other absorbents, such as silica gel, active carbon, alumina, etc., have insufficient dehydration activity in polar solvents such as ethanol. However, the molecular sieve has high absorption capacity, that is, the range from 20 to 25 weight %.

When a distillation method is used to dry the ethanol solution, the ethanol concentration rises to 96 weight % because of its azeotrope point. On the other hand, by using molecular sieves it is possible to raise the ethanol concentration to more than 99.9 weight %. Furthermore, distillation methods consume an undesirable amount of energy, while the molecular sieve method does not.

Preferably, the defatted miscella, from which oil and fat have been removed, is subjected to normal pressure or vacuum distillation to obtain a distillate, which is then fed to the absorption column in which the molecular sieve material is contained. In order to use the absorption columns effectively, when one absorption column is being subjected to the absorption process, one or more absorption columns are subjected to a regenerative process. By this method the process becomes continuous and efficient. The regenerative process for the molecular sieve material is performed by recycling an inactive gas, for example, nitrogen gas, carbon dioxide gas, etc., which is heated to the range of from 180° C. to 300° C.

One characteristic of the present invention is the step in which the miscella or the distillate having a water content from 1% to 10% is contacted with the molecular sieve material. The molecular sieve material is not contacted with solvent which contains a great deal of water.

For the fifth step (step (e)), the ethanol solution obtained in step (d) is used as the extracting solvent of step (b) of a new batch of flakes. Since the ethanol concentration of step (b) is not less than 90 wt %, it is possible to mix the ethanol solution of step (d) having a very high ethanol concentration with additional ethanol solution having a lower ethanol concentration, for example, as obtained in the present process prior to drying.

By the method of the present invention, solvent having a high ethanol concentration is used in an extraction process, and the extraction and separation apparatus are thereby simplified. Furthermore, in the extraction process the extracting temperature is lowered from the boiling point, and the extracting time is shortened. The heat load of this process is lower than that of the known distillation processes, particularly during the dehydration steps. Since the solvent ratio is also lowered, the heat load during heating and cooling steps of the separating process is also lowered.

Having now generally described the invention, the same will be better understood be reference to certain specific examples, which are included for purposes of illustration only and are not intended to be limiting of this invention or any embodiment thereof, unless specified.

EXAMPLE 1

Full-fat soybean flakes were extracted in accordance with the process shown in the FIGURE.

The raw soybean flakes (1), containing 8.1 wt % water and 19.9 wt % oil, were fed to a counter current extracting apparatus (I–IV), and contacted an ethanol solution (7) at 70° C., of which the ethanol concentration was 95.5 wt %. A miscella and the defatted soybean residue (2), containing 0.8 wt % oil, were obtained. The miscella of each stage was cooled to 30° C. by heat exchangers (B2–B4). The precipitates were separated by separators (C2–C4). The miscella after the separation process were heated to 70° C. by heaters (A2–A4) and fed to the next extracting apparatus (I–III). The last miscella (3), containing 90.8 wt % ethanol, was cooled to 30° C. by a heat exchanger (B1).

The precipitated oil was separated by a separator (C1). Thirty weight percent of the defatted miscella after the separation process was fed to the extracting apparatus (IV) as the recycle defatted miscella (4). Seventy percent of another defatted miscella (5) was distilled in an evaporator (D), and the vapor was fed to a condensor (E). The condensed ethanol solution, contained 8 wt % water, was fed to a column (F), containing Molecular Sieve 3A and dehydrated to 97.9 wt % ethanol. The resulting solution (6) was fed to a work tank (G). This high-concentration ethanol was mixed with the defatted miscella (4), adjusted to an ethanol concentration of 95 wt %, and then fed to the extracting apparatus (IV) as the extracting solvent (7).

EXAMPLE 2

In this example, dehydration activity was compared. The several absorbents shown in Table I were used in the same manner in column (F) of example 1. The ethanol concentration after dehydration is shown in Table I.

TABLE I

| Absorbents | Ethanol Conc. (weight %) |
|---|---|
| Molecular Sieve 3A | 97.9 |
| Molecular Sieve 4A | 96.9 |
| Molecular Sieve 5A | 94.4 |
| Silica gel | 91.3 |
| Active Carbon | 87.6 |

EXAMPLE 3

The several kinds of soybean flakes shown in Table II were extracted in the same manner as Example I. For example raw soybean flakes, containing 6.0 wt % water and 20.3 wt % oil, were contacted with an ethanol solution at 70° C., the ethanol having a concentration of 95.4 wt % (Solvent ratio 1.3). Miscella and defatted soybean residue containing 0.5 wt % oil were obtained. Seventy wt % of the last miscella, containing 92.3 wt % ethanol was distilled and dehydrated in the column containing Molecular Sieve 3A. The required amount of the molecular sieves is 65% of that amount which was required when using flakes that contained 8.1 wt % water. The results are shown in Table II.

TABLE II

| | Example No. | | | | | |
|---|---|---|---|---|---|---|
| | 1 | 2 | 3 | 4 | 5 | 6 |
| Water content of the flakes (%) | 1.9 | 3.8 | 6.0 | 8.1 | 10.2 | 12.3 |
| Oil content of the flakes (%) | 21.2 | 20.8 | 20.3 | 19.9 | 19.6 | 19.0 |
| Ethanol conc. (wt %) | 95.4 | 95.3 | 95.4 | 95.5 | 95.4 | 95.3 |
| Ethanol conc. of the last miscella (wt %) | 95.2 | 93.8 | 92.3 | 90.8 | 89.5 | 88.1 |

TABLE II-continued

| | Example No. | | | | | |
|---|---|---|---|---|---|---|
| | 1 | 2 | 3 | 4 | 5 | 6 |
| Oil content of the defatted flakes (wt %) | 0.4 | 0.5 | 0.5 | 0.8 | 1.1 | 1.8 |
| Required amount of the molecular sieves | 5 | 32 | 65 | 100 | 130 | 160 |

The required amount of molecular sieve material when the soybean flakes contained 8.1 wt % water was used is 100 for the comparison. This amount may vary from batch to batch (or when switching types) of molecular sieve material and may be determined by simple experimentation.

The invention now being fully described, it will be apparent to one with ordinary skill in the art that many changes and modifications can be made thereto without departing from the spirit or scope of the invention as set forth herein.

What is claimed as new and desired to be secured by letters patent of the United States is:

1. A process of extracting vegetable oil and fat from an oleaginous raw material, which comprises the steps of:

(a) obtaining flakes having a moisture content of from 0.7 to 10 weight % from an oleaginous raw material, said flake being characterized by the absence of an impervious outer hull or coat;

(b) contacting said flakes with an ethanol solution containing not less than 90 weight % ethanol at a temperature in the range from 70° C. to the boiling point of said ethanol solution, thereby obtaining a miscella, (c) cooling said miscella, thereby obtaining vegetable oil or fat or both and a separate defatted miscella;

(d) drying said defatted miscella with a molecular sieve material having a pore size from 3Å to 4Å, thereby obtaining a second ethanol solution wherein said second ethanol solution contains less than 7 weight % water; and (e) using said second ethanol solution as the ethanol solution of said contacting step in a second extraction.

2. The process of claim 1, wherein said separate defatted miscella is distilled under normal or reduced pressure prior to said drying.

3. The process of claim 1, wherein said oleaginous raw material is soybeans, rape seeds, cotton seeds, peanuts, sesame seeds, sunflower seeds, wheat germ, corn germ, or rice germ.

4. The process of claim 1, wherein the ethanol solution of step (b) contains not less than 95 weight % ethanol.

5. The process of claim 1, wherein said cooling is to a temperature of from 10° C. to 35° C.

6. The process of claim 1, wherein said molecular sieve material is a crystalline zeolite.

* * * * *